US010128620B1

(12) United States Patent
Wu et al.

(10) Patent No.: US 10,128,620 B1
(45) Date of Patent: Nov. 13, 2018

(54) HIGH SPEED VERTICAL CONNECTOR

(71) Applicant: Greenconn Corp., New Taipei (TW)

(72) Inventors: Kun-Shen Wu, New Taipei (TW); Keh-Chang Cheng, New Taipei (TW)

(73) Assignee: GREENCONN CORP., New Taipei (TW)

( * ) Notice: Subject to any disclaimer, the term of this patent is extended or adjusted under 35 U.S.C. 154(b) by 0 days.

(21) Appl. No.: 15/717,671

(22) Filed: Sep. 27, 2017

(51) Int. Cl.

| | |
|---|---|
| ***H01R 13/6585*** | (2011.01) |
| ***H01R 24/60*** | (2011.01) |
| ***H01R 13/502*** | (2006.01) |
| ***H01R 13/41*** | (2006.01) |
| *H01R 107/00* | (2006.01) |

(52) U.S. Cl.
CPC ..... *H01R 13/6585* (2013.01); *H01R 13/41* (2013.01); *H01R 13/502* (2013.01); *H01R 24/60* (2013.01); *H01R 2107/00* (2013.01)

(58) Field of Classification Search
CPC . H01R 13/6585; H01R 24/60; H01R 2107/00
USPC ..... 439/607.09
See application file for complete search history.

(56) References Cited

U.S. PATENT DOCUMENTS 4,806,110 A * 2/1989 Lindeman ..... H01R 13/2407 439/108
5,634,819 A * 6/1997 Pan ..... H01R 12/721 439/637
6,315,615 B1 * 11/2001 Raistrick ..... H01R 12/585 439/637
6,994,563 B2 * 2/2006 Amini ..... H05K 1/117 361/777
7,410,392 B2 * 8/2008 Szczesny ..... H01R 12/585 439/108
8,177,564 B1 * 5/2012 Ito ..... H01R 13/6471 439/108
8,231,411 B1 * 7/2012 Westman ..... H01R 13/6471 439/108
8,419,457 B2 * 4/2013 Lee ..... H01R 13/6471 439/326
8,523,583 B2 * 9/2013 Ito ..... H01R 12/721 439/108
8,784,116 B2 * 7/2014 Buck ..... H01R 12/585 439/55

(Continued)

*Primary Examiner* — Alexander Gilman
(74) *Attorney, Agent, or Firm* — Li & Cai Intellectual Property (USA) Office

(57) ABSTRACT

A conductive module of a high speed vertical connector includes an insulating core and a plurality of conductive terminals fixed on the insulating core. Each conductive terminal includes an embedded segment embedded in the insulating core, a fixing segment and a curved segment respectively extending from two opposite ends of the embedded segment, and a contacting segment extending from the curved segment. The embedded segment has a width within a range of 0.28~0.42 mm. The fixing segment has a width within a range of 0.25~0.28 mm. The curved segment has a width within a range of 0.35~0.42 mm. The contacting segment has a width within a range of 0.25~0.28 mm. The conductive terminals include a plurality pairs of differential signal terminals and a plurality of grounding terminals each arranged between two adjacent pairs of the differential signal terminals. Any two grounding terminals are not connected to any conductive bar.

6 Claims, 10 Drawing Sheets

(56) References Cited

U.S. PATENT DOCUMENTS

| | | | | |
|---|---|---|---|---|
| 8,860,454 | B2 * | 10/2014 | Oniyama | H01R 13/20 324/762.01 |
| 9,520,678 | B2 * | 12/2016 | Su | H01R 13/6477 |
| 9,531,130 | B1 * | 12/2016 | Phillips | H01R 13/6471 |
| 9,768,557 | B2 * | 9/2017 | Phillips | H01R 13/6585 |
| 2003/0203679 | A1 * | 10/2003 | Bu | H01R 12/7029 439/637 |
| 2004/0242072 | A1 * | 12/2004 | Kumamoto | H01R 13/6585 439/607.05 |
| 2011/0300757 | A1 * | 12/2011 | Regnier | H01R 29/00 439/626 |
| 2013/0012038 | A1 * | 1/2013 | Kirk | H01R 12/721 439/55 |
| 2013/0065454 | A1 * | 3/2013 | Milbrand, Jr. | H01R 12/724 439/676 |
| 2013/0252449 | A1 * | 9/2013 | Tang | H01R 12/721 439/325 |
| 2018/0062323 | A1 * | 3/2018 | Kirk | H01R 13/6585 |

* cited by examiner

HIGH SPEED VERTICAL CONNECTOR

BACKGROUND OF THE INVENTION

1. Field of the Invention

The present disclosure relates to a connector; in particular, to a high speed vertical connector and a conductive module thereof each provided without any conductive bar.

2. Description of Related Art

A conventional high speed vertical connector includes a plurality grounding terminals and a conductive bar connected to the grounding terminals, so that the grounding terminals are electrically connected to each other by using the conductive bar. Thus, the performance of the conventional high speed vertical connector can be increased by installing the conductive bar, thereby overcoming the corresponding tests.

However, the performance and the corresponding tests for the conventional high speed vertical connector are dependent on the conductive bar, so that the structure of the conventional high speed vertical connector needs to be changed or adjusted based on the conductive bar. Thus, the conventional high speed vertical connector becomes more complicated. In other words, the development in improving the conductive terminals of the vertical connector field has long been neglected.

SUMMARY OF THE INVENTION

The present disclosure provides a high speed vertical connector and a conductive module thereof to effectively improve the drawbacks associated with conventional high speed vertical connectors.

The present disclosure discloses a high speed vertical connector, which includes an insulating body and two conductive modules. The two conductive modules are inserted into the insulating body. Each of the two conductive modules includes a plurality of conductive terminals arranged in one row and an insulating core fixing the row of the conductive terminals. Each of the conductive terminals is integrally formed as one elongated piece, and includes an embedded segment, a fixing segment, a curved segment, and a contacting segment. The embedded segment is embedded in the corresponding insulating core. The embedded segment has a width within a range of 0.28~0.42 mm. The fixing segment and the curved segment respectively extend from two opposite ends of the embedded segment. The fixing segment has a width within a range of 0.25~0.28 mm, and the curved segment has a width within a range of 0.35~0.42 mm. The contacting segment extends from the curved segment, and the contacting segment has a width within a range of 0.25~0.28 mm. The conductive terminals of one of the two conductive modules respectively face the conductive terminals of the other conductive module. In any two of the conductive terminals respectively belonging to the two conductive modules and facing each other, the two facing conductive terminals have a minimum gap between the contacting segments thereof, and the two embedded segments are substantially parallel to each other. In each of the two conductive modules, the conductive terminals include a plurality of pairs of differential signal terminals and a plurality of grounding terminals, and any two adjacent pairs of the differential signal terminals are provided with one of the grounding terminals arranged there-between. The high speed vertical connector is devoid of a conductive bar used for connecting at least two of the grounding terminals.

The present disclosure also discloses a high speed vertical connector for being applied to a frequency band within a range of 0.05~17 GHz and consisting of an insulating body, two conductive modules inserted into the insulating body, and a metallic housing sleeved at the insulating body. Each of the two conductive modules includes a plurality of conductive terminals arranged in one row and an insulating core fixing the row of the conductive terminals. Each of the conductive terminals is integrally formed as one elongated piece and consists of an embedded segment, a fixing segment, a curved segment, and a contacting segment. The embedded segment is embedded in the corresponding insulating core. The embedded segment has a width within a range of 0.28~0.42 mm. The fixing segment and the curved segment respectively extend from two opposite ends of the embedded segment. The fixing segment has a width within a range of 0.25~0.28 mm, and the curved segment has a width within a range of 0.35~0.42 mm. The contacting segment extends from the curved segment, and the contacting segment has a width within a range of 0.25~0.28 mm. The conductive terminals of one of the two conductive modules respectively face the conductive terminals of the other conductive module. In each of the two conductive modules, the conductive terminals include a plurality of pairs of differential signal terminals and a plurality of grounding terminals, and any two adjacent pairs of the differential signal terminals are provided with one of the grounding terminals arranged there-between.

The present disclosure further discloses a conductive module of a high speed vertical connector, and the conductive module includes an insulating core and a plurality of conductive terminals. The conductive terminals are arranged in one row and are fixed on the insulating core. Each of the conductive terminals is integrally formed as one elongated piece and includes an embedded segment, a fixing segment, a curved segment, and a contacting segment. The embedded segment is embedded in the corresponding insulating core. The embedded segment has a width within a range of 0.28~0.42 mm. The fixing segment and the curved segment respectively extend from two opposite ends of the embedded segment. The fixing segment has a width within a range of 0.25~0.28 mm, and the curved segment has a width within a range of 0.35~0.42 mm. The contacting segment extends from the curved segment, and the contacting segment has a width within a range of 0.25~0.28 mm. In each of the two conductive modules, the conductive terminals include a plurality of pairs of differential signal terminals and a plurality of grounding terminals, and any two adjacent pairs of the differential signal terminals are provided with one of the grounding terminals arranged there-between. Any two of the grounding terminals of the conductive module are not configured to connect a conductive bar.

In summary, the high speed vertical connector of the present disclosure is provided with a better high frequency transmission performance (i.e., an insertion loss and a return loss) by designing the size of each conductive terminal and the cooperation between the conductive terminals and the insulating core, so that the high speed vertical connector can be provided without any conductive bar which is used for connecting at least two grounding terminals.

In order to further appreciate the characteristics and technical contents of the present disclosure, references are hereunder made to the detailed descriptions and appended drawings in connection with the present disclosure. However, the appended drawings are merely shown for exemplary purposes, and should not be construed as restricting the scope of the present disclosure.

DETAILED DESCRIPTION OF THE PREFERRED EMBODIMENTS

Reference is made to FIGS. 1 to 10, which illustrate the present disclosure. References are hereunder made to the detailed descriptions and appended drawings in connection with the present disclosure. However, the appended drawings are merely provided for exemplary purposes, and should not be construed as restricting the scope of the present disclosure.

Figure 1:
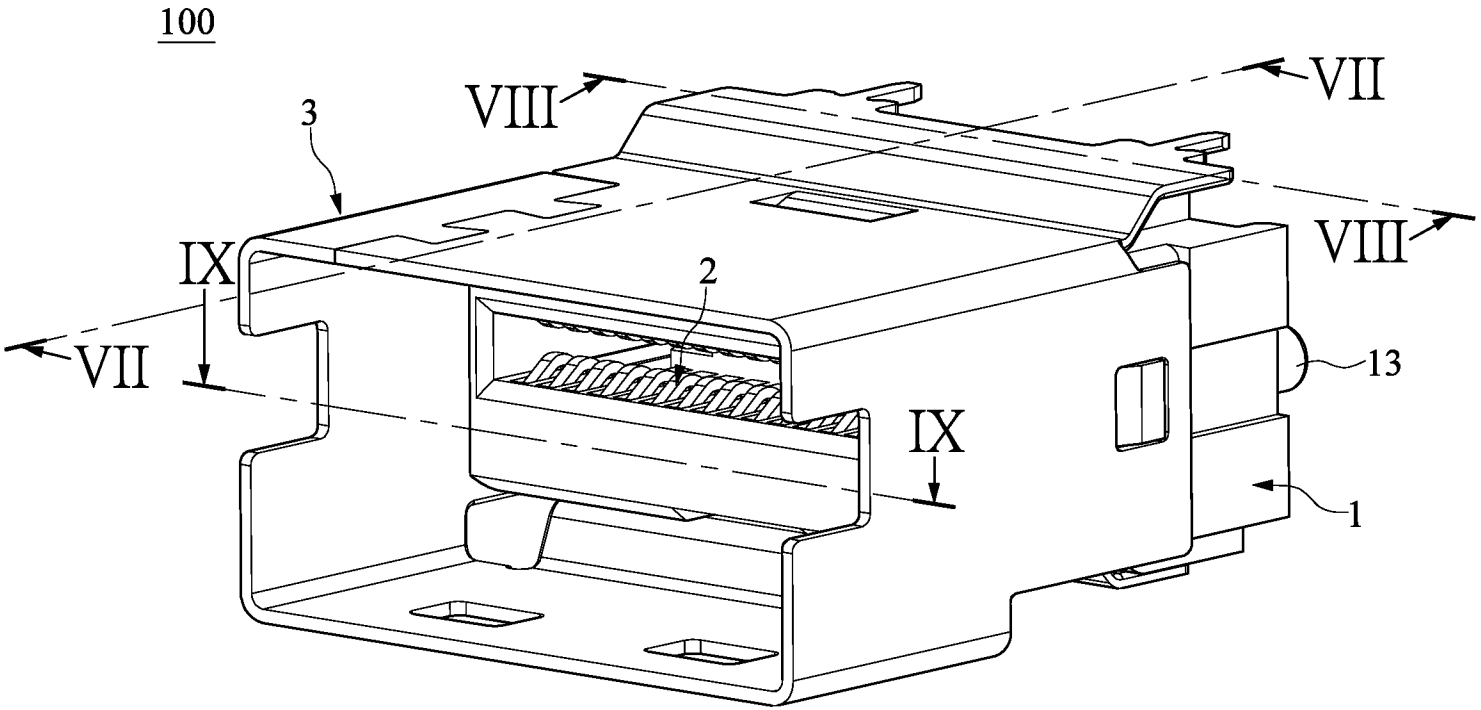
FIG. 1 is a perspective view showing a high speed vertical connector according to an embodiment of the present disclosure.
Figure 2:
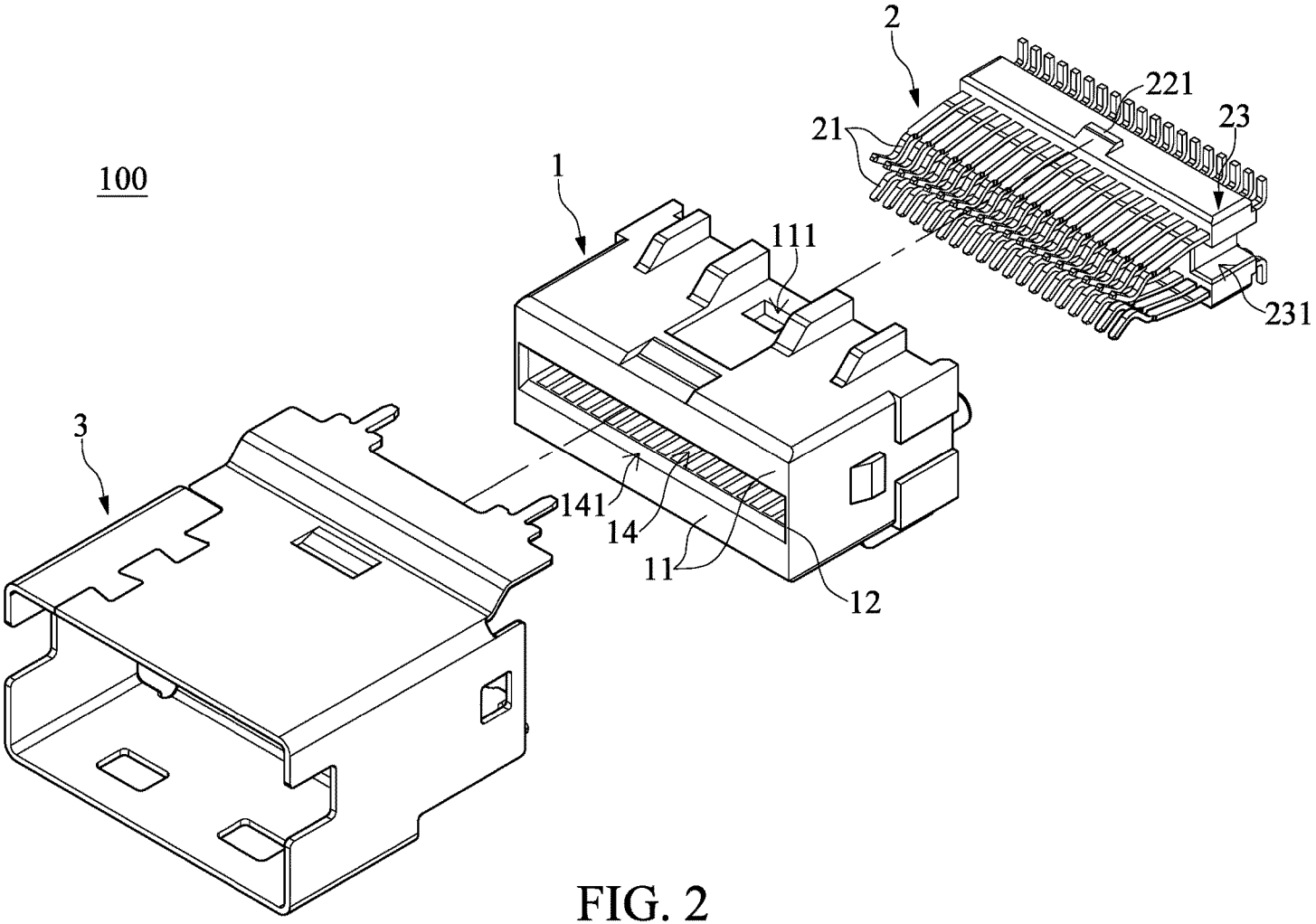
FIG. 2 is an exploded view of FIG. 1.
Figure 3:
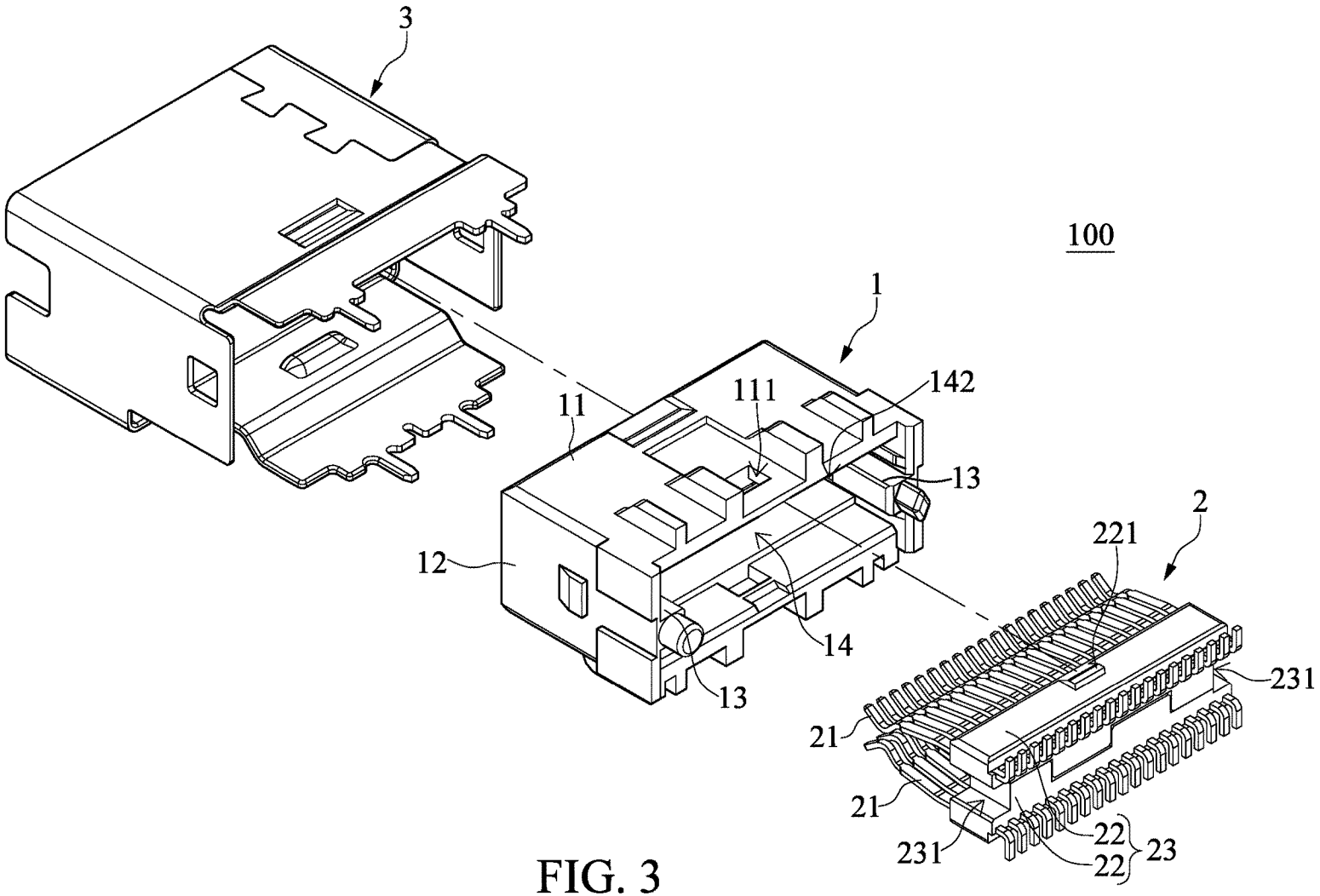
FIG. 3 is an exploded view of FIG. 1 from another perspective.

Reference is first made to FIGS. 1 to 3, which illustrate a high speed vertical connector 100 according to an embodiment of the present disclosure. The high speed vertical connector 100 of the present embodiment is preferably applied to a frequency within a range of 0.05~17 GHz and has a high speed transmission function (i.e., 22.5 Gbps). The high speed vertical connector 100 of the present embodiment is devoid of a conductive bar which is used for connecting at least two grounding terminals. That is to say, the high speed vertical connector 100 of the present embodiment is different from any right angle connector, and is also different from any connector having a conductive bar.

The high speed vertical connector 100 includes an insulating body 1, two conductive modules 2 inserted into the insulating body 1, and a metallic housing 3 sleeved at the insulating body 1. In other words, the high speed vertical connector 100 in the present embodiment can consist of the insulating body 1, the two conductive modules 2, and the metallic housing 3. That is to say, the high speed vertical connector 100 in the present embodiment can be defined by a close ended transition, but the present disclosure is not limited thereto. The following description discloses the structure and connection of each component of the high speed vertical connector 100.

The insulating body 1 includes two long side walls 11 facing each other, two short side walls 12 facing each other, and two positioning columns 13 facing each other and respectively extending from the inner surfaces of the two short side walls 12. The two long side walls 11 and the two short side walls 12 are jointly defined as a rectangular ring structure, which has a penetrating slot 14. The two positioning columns 13 are approximately arranged in the penetrating slot 14. Moreover, an end portion of each of the two positioning columns 13 protrudes from the penetrating slot 14, and the end portions of the two positioning columns 13 have different structures.

Specifically, the penetrating slot 14 has a front opening 141 and a rear opening 142 respectively arranged at two opposite sides thereof. The front opening 141 is provided for an insertion of a mating component (e.g., a connector or an electronic card), and the rear opening 142 is provided for the insertion of the two conductive modules 2. The insulating body 1 has two buckling holes 111 respectively recessed in the two long side walls 11 and facing each other. The two buckling holes 111 and the two positioning columns 13 are arranged close to the rear opening 142.

Figure 4:
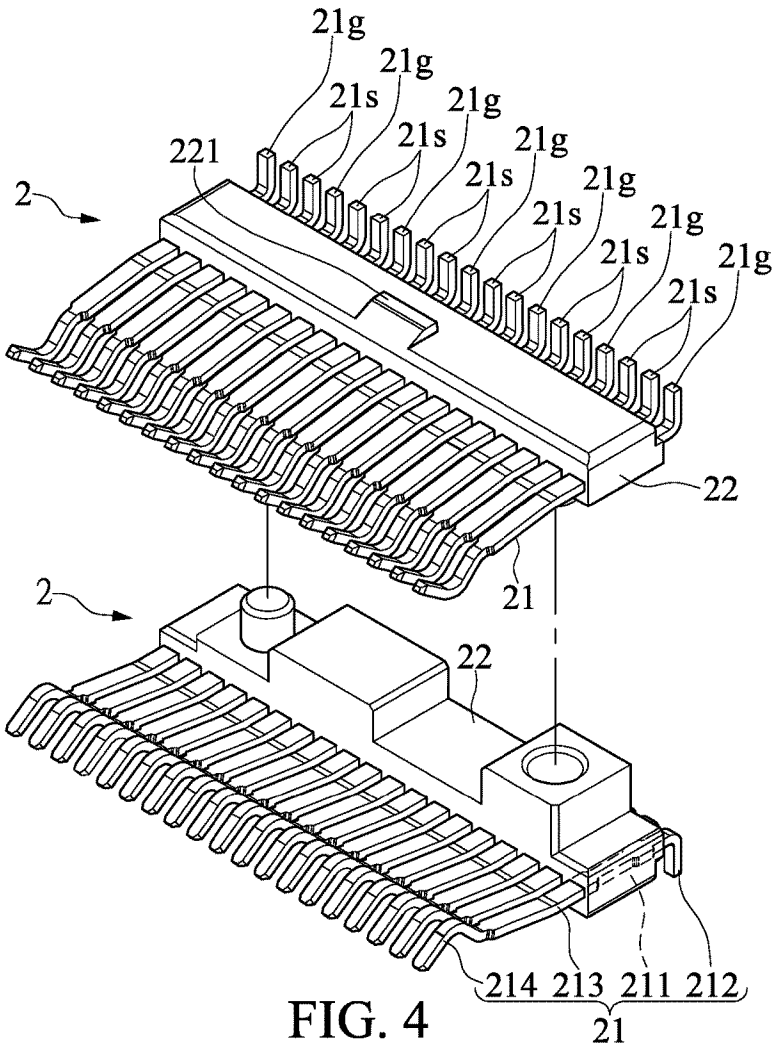
FIG. 4 is an exploded view showing two conductive modules of FIG. 2.

As shown in FIGS. 3 and 4, each of the two conductive modules 2 includes a plurality of conductive terminals 21 arranged in one row and an insulating core 22 fixing the row of the conductive terminals 21. Each of the two insulating cores 22 has a protrusion 221, and the protrusions 221 of the two insulating cores 22 are respectively buckled in the two buckling holes 111 of the insulating body 1.

Specifically, the two insulating cores 22 of the two conductive modules 2 in the present embodiment are the same or a symmetrical structure, and the two insulating cores 22 are detachably buckled with each other to form an elongated structure 23. The elongated structure 23 has two positioning troughs 231 recessed on two opposite ends thereof. The two positioning columns 13 of the insulating body 1 are respectively inserted into the two positioning troughs 231 of the elongated structure 23. The end portion of each of the two positioning columns 13 protrudes from the corresponding positioning trough 231.

Accordingly, the two insulating cores 22 of the high speed vertical connector 100 have the same or a symmetrical structure and are buckled with each other, so that the insulating cores 22 can be produced by using one mold for reducing cost. Moreover, the two buckled insulating cores 22 are fastened to the insulating body 1 by using the positioning slots 231 to cooperate with the positioning columns 13, so that the connection between the two buckled insulating cores 22 and the insulating body 1 can be more firm.

As the conductive terminals 21 are of the same structure, the following description only discloses the structure of one of the conductive terminals 21 for the sake of brevity. However, the conductive terminals 21 in the present disclosure are not limited to the same structure. In other embodiments of the present disclosure, the conductive terminals 21 of the high speed vertical connector 100 can be formed in different structures.

Figure 5:
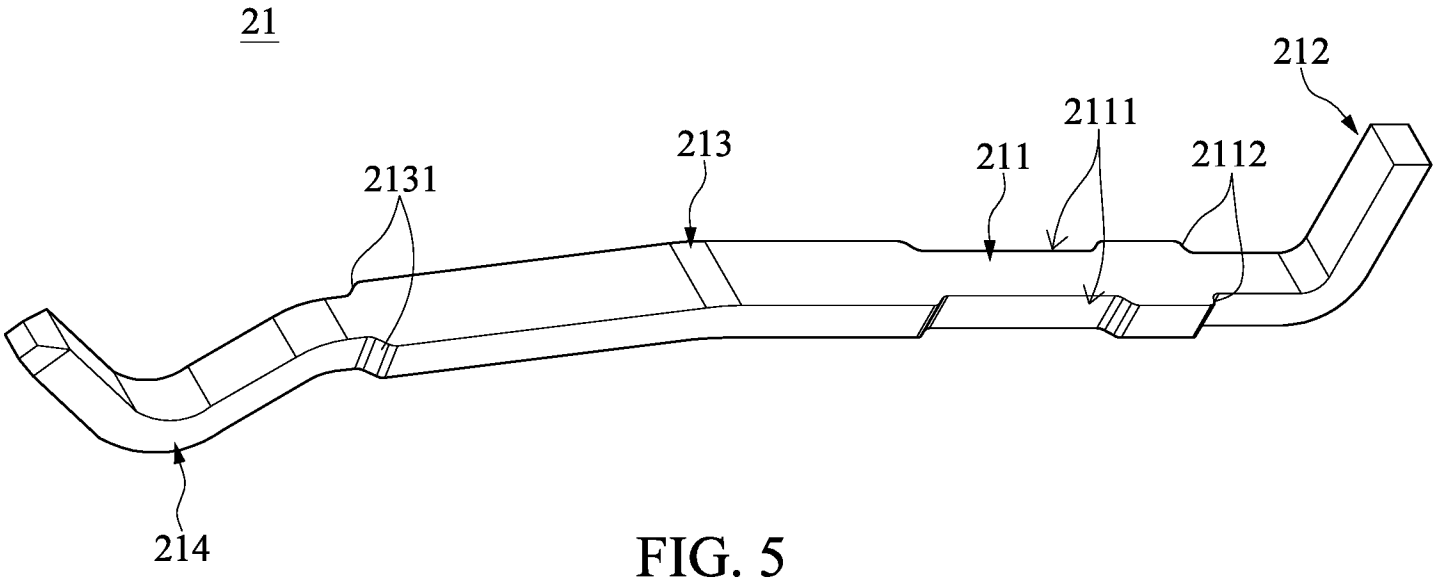
FIG. 5 is a perspective view showing a conductive terminal of FIG. 4.
Figure 6:
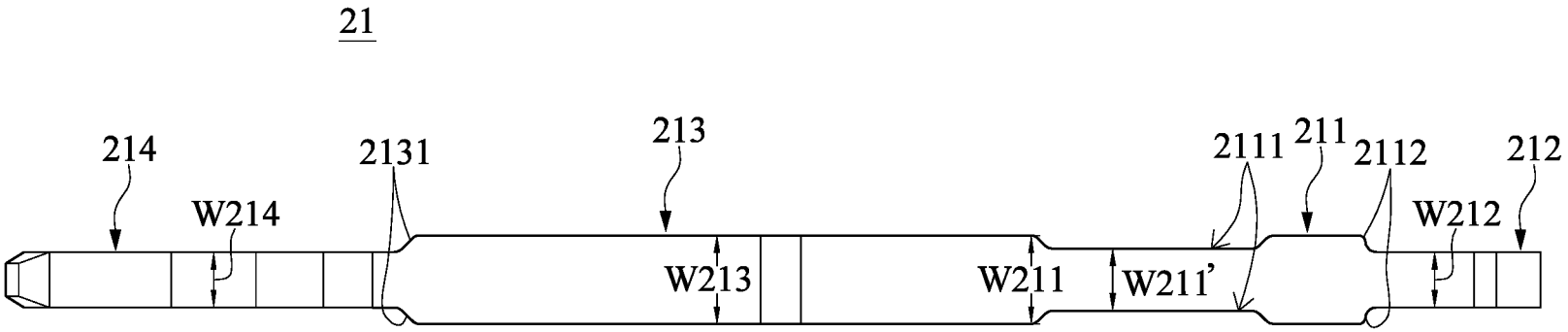
FIG. 6 is a planar view of FIG. 5.
Figure 7:
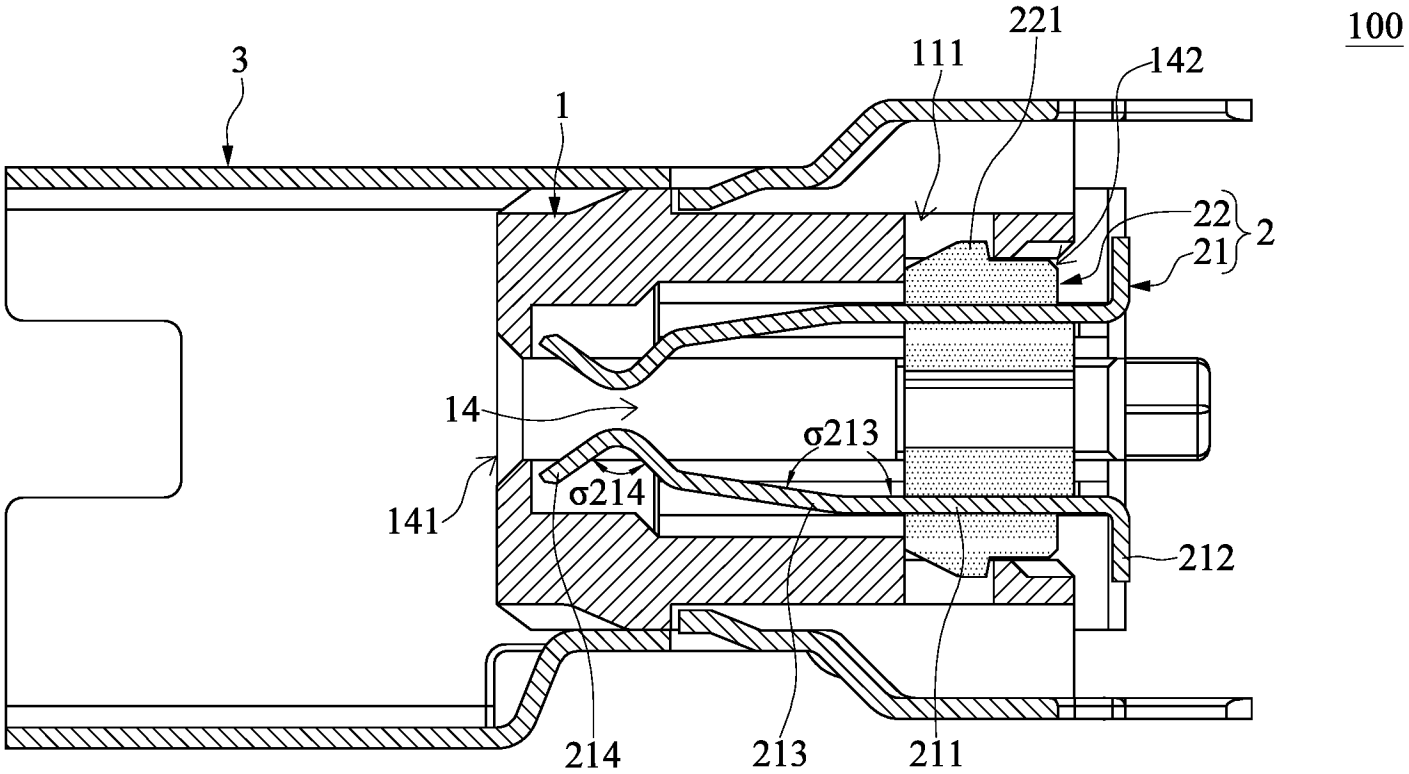
FIG. 7 is a cross-sectional view taken along a cross-sectional line VII-VII of FIG. 1.
Figure 8:
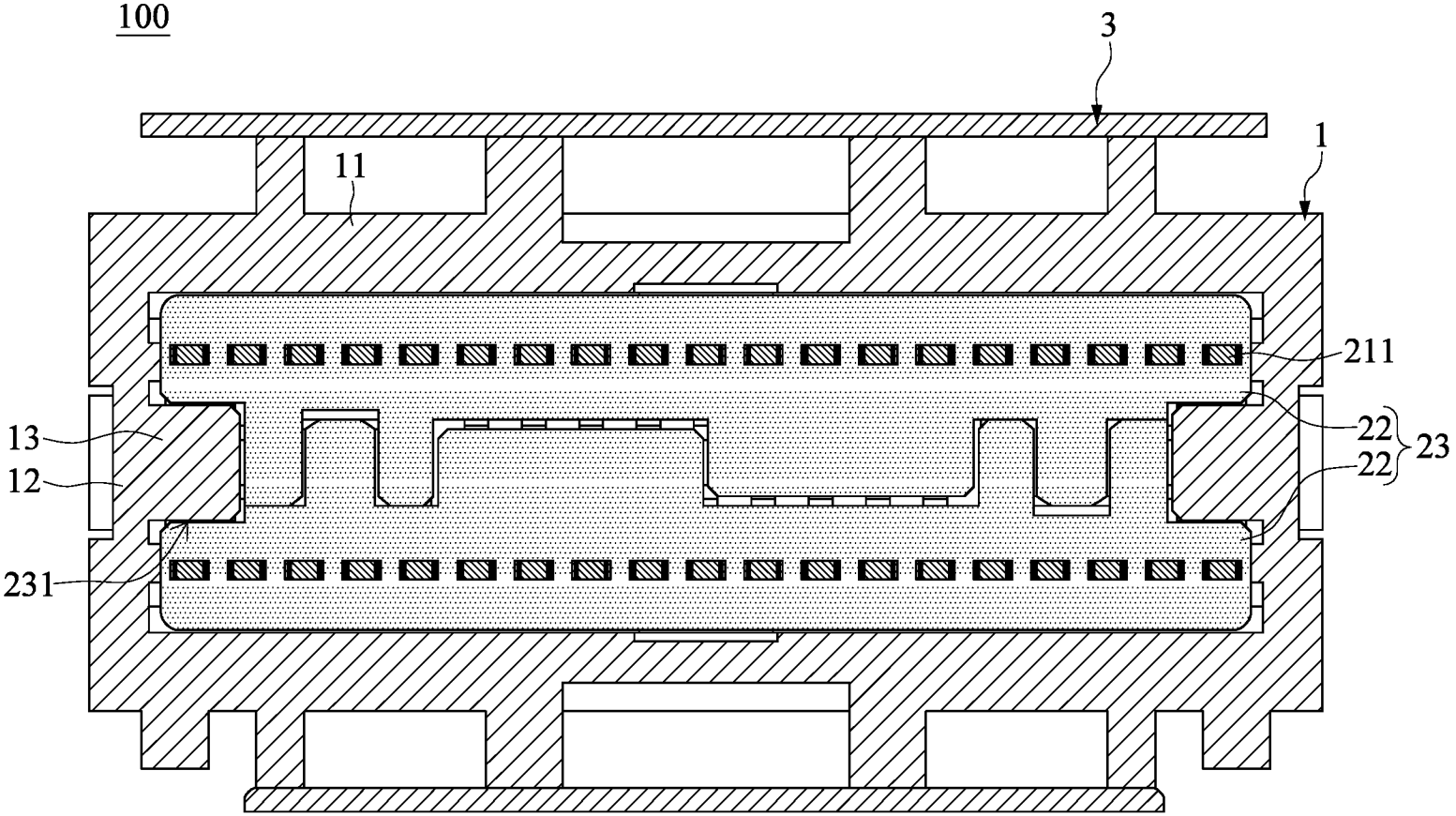
FIG. 8 is a cross-sectional view taken along a cross-sectional line VIII-VIII of FIG. 1.
Figure 9:
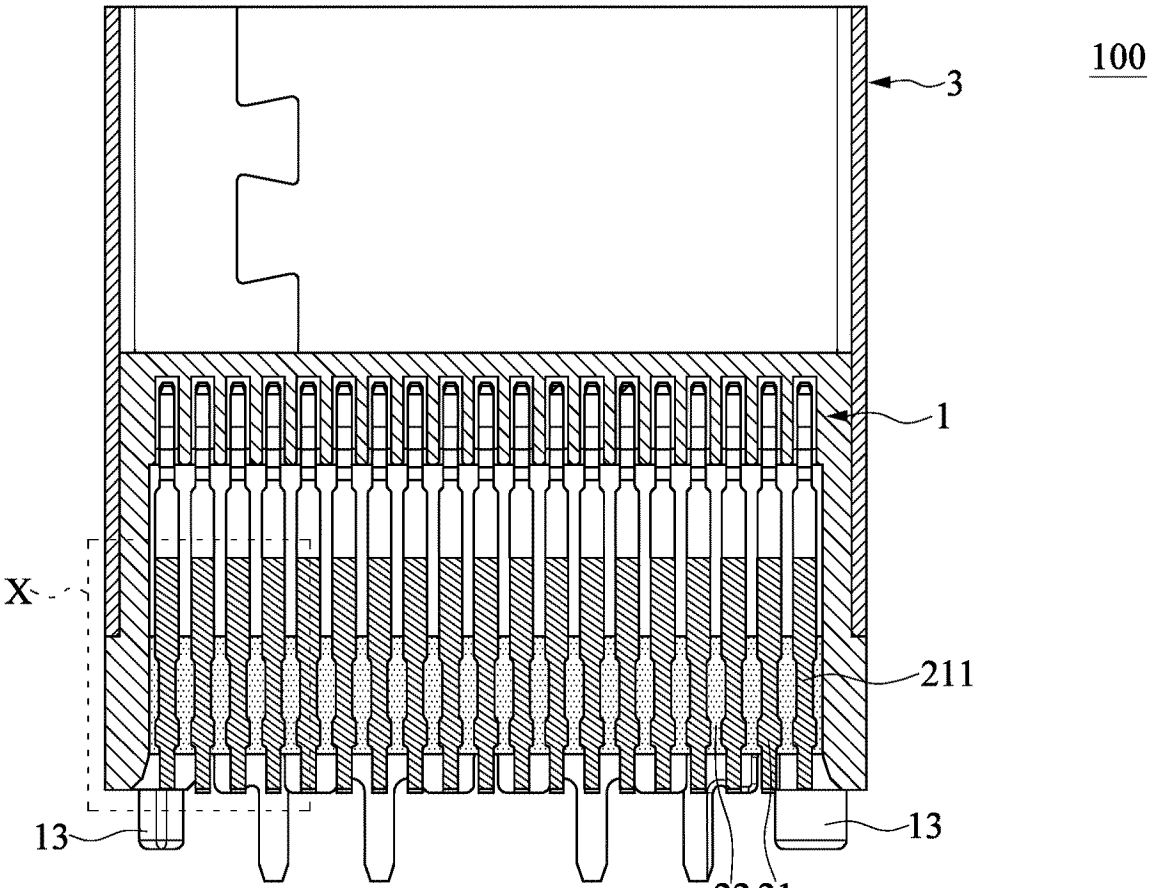
FIG. 9 is a cross-sectional view taken along a cross-sectional line IX-IX of FIG. 1.

As shown in FIGS. 5 to 10, the conductive terminal 21 is integrally formed as one elongated piece. The conductive terminal 21 includes an embedded segment 211, a fixing segment 212 extending from an end of the embedded segment 211 (i.e., the right end of the embedded segment 211 as shown in FIG. 5), a curved segment 213 extending from the other end of the embedded segment 211 (i.e., the left end of the embedded segment 211 as shown in FIG. 5), and a contacting segment 214 extending from the curved segment 213 in a direction away from the embedded segment 211.

Figure 10:
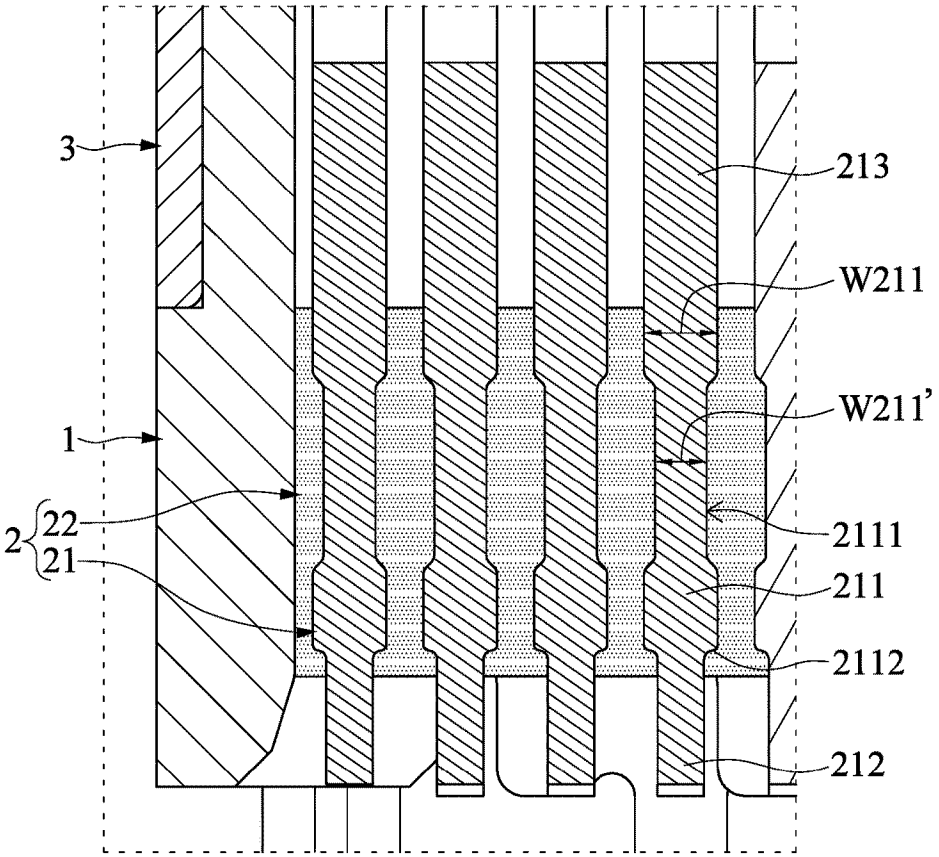
FIG. 10 is an enlarged view showing the X portion of FIG. 9.

The embedded segment 211 is embedded in the corresponding insulating core 22, and the embedded segment 211 has a width W211, W211' within a range of 0.28~0.42 mm. Specifically, the embedded segment 211 has two concavities 2111 respectively formed on two opposite sides thereof. A length of each of the two concavities 2111 is substantially 50~65% of a length of the embedded segment 211 (as shown in FIG. 10). A distance (i.e., the width W211') between the bottom surfaces of the two concavities 2111 is within a range of 0.26~0.3 mm. In other words, the width W211, W211' of the embedded segment 211 in the present embodiment has at least two values, and the shape of the embedded segment 211 is similar to "I", but the present disclosure is not limited thereto.

The fixing segment 212 has a width W212 within a range of 0.25~0.28 mm, and the width W212 of the fixing segment 212 in the present embodiment has only one value. The fixing segment 212 is an L-shaped SMT (surface mounting technology) structure. In other words, a portion of the conductive terminal 21, which is arranged outside the insulating core 22 and protrudes from the penetrating slot 14, is defined as the fixing segment 212. Specifically, for the adjacent portions of the fixing segment 212 and the embedded segment 211, because the width W212 of the fixing segment 212 is smaller than the width W211 of the embedded segment 211, the embedded segment 211 has two chamfers 2112 respectively connected to two opposite sides of the fixing segment 212. That is to say, each of the conductive terminals 2 in the present embodiment is provided without a tapered structure for connecting the fixing segment 212 and the embedded segment 211 thereof, thereby preventing the tapered structure from affecting the signal transmission of the conductive terminal 21.

The curved segment 213 has a width W213 within a range of 0.35~0.42 mm, and the width W213 of the curved segment 213 in the present embodiment has only one value. The curved segment 213 in the present embodiment has an angle σ213 (i.e., 170 degrees) smaller than 180 degrees. Specifically, for the adjacent portions of the curved segment 213 and the embedded segment 211, the width W213 of the curved segment 213 is substantially equal to the width W211 of the embedded segment 211. That is to say, the curved segment 213 is straightly extending from the embedded segment 211 in a direction away from the fixing segment 213, and then is curvedly extending away from the fixing segment 213.

The contacting segment 214 has a width W214 within a range of 0.25~0.28 mm, and the width W214 of the contacting segment 214 in the present embodiment has only one value. The contacting segment 214 in the present embodiment has an angle σ214 (i.e., 100 degrees) within a range of 90~120 degrees. The angle σ214 of the contacting segment 214 and the angle σ213 of the curved segment 213 are respectively formed on two opposite sides of the conductive terminal 21. Specifically, for the adjacent portions of the contacting segment 214 and the curved segment 213, because the width W214 of the contacting segment 214 is smaller than the width W213 of the curved segment 213, the curved segment 213 has two chamfers 2131 respectively connected to two opposite sides of the contacting segment 214. That is to say, each of the conductive terminals 21 in the present embodiment is provided without a tapered structure for connecting the contacting segment 214 and the curved segment 213 thereof, thereby preventing the tapered structure from affecting the signal transmission of the conductive terminal 21.

The structure of the single conductive terminal 21 has been disclosed in the above description, and the following description discloses the relationship between the two conductive modules 2, but the present disclosure is not limited thereto. The conductive terminals 21 of one of the two conductive modules 2 respectively face the conductive terminals 21 of the other conductive module 2. In any two of the conductive terminals 21 which respectively belong to the two conductive modules 2 and are arranged to face each other, the two facing conductive terminals 21 have a minimum gap between the contacting segments 214 thereof for abutting against conductive portions of the mating component (not shown), and the two embedded segments 211 are substantially parallel to each other.

Moreover, in each of the two conductive modules 2 (as shown in FIG. 4), the conductive terminals 21 include a plurality of pairs of differential signal terminals 21*s* and a plurality of grounding terminals 21*g*, and any two adjacent pairs of the differential signal terminals 21*s* are provided with one of the grounding terminals 21*g* arranged therebetween. It should be noted that the high speed vertical connector 100 in the present embodiment is devoid of a conductive bar which is used for connecting to at least two of the grounding terminals 21*g*. In other words, any two of the grounding terminals 21*g* of the conductive module 2 are not configured to connect a conductive bar, so that any two of the grounding terminals 21*g* of the conductive module 2 are electrically isolated with each other.

The Effects of the Present Disclosure

In summary, the high speed vertical connector 100 of the present embodiment is provided with a better high frequency transmission performance (i.e., an insertion loss and a return loss) by designing the size of each conductive terminal 21 and the cooperation between the conductive terminals 21 and the insulating core 22, so that the high speed vertical connector 100 can be provided without any conductive bar which is used for connecting at least two grounding terminals.

Moreover, the two insulating cores 22 of the high speed vertical connector 100 in the present embodiment have the same or a symmetrical structure and are buckled with each other, so that the insulating cores 22 can be produced by using one mold for reducing cost. In addition, the two buckled insulating cores 22 are fastened to the insulating body 1 by using the positioning slots 231 to cooperate with the positioning columns 13, so that the connection between the two buckled insulating cores 22 and the insulating body 1 can be more firm.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A high speed vertical connector, comprising:

an insulating body; and two conductive modules inserted into the insulating body, wherein each of the two conductive modules includes a plurality of conductive terminals arranged in one row and an insulating core fixing the row of the conductive terminals, and each of the conductive terminals is integrally formed as one elongated piece and includes:

an embedded segment embedded in the corresponding insulating core, wherein the embedded segment has a width within a range of 0.28~0.42 mm;

a fixing segment and a curved segment respectively extending from two opposite ends of the embedded segment, wherein the fixing segment has a width within a range of 0.25~0.28 mm, and the curved segment has a width within a range of 0.35~0.42 mm; and a contacting segment extending from the curved segment, wherein the contacting segment has a width within a range of 0.25~0.28 mm;

wherein the conductive terminals of one of the two conductive modules respectively face the conductive terminals of the other conductive module; in any two of the conductive terminals respectively belonging to the two conductive modules and facing each other, the two facing conductive terminals have a minimum gap between the contacting segments thereof, and the two embedded segments are substantially parallel to each other;

wherein in each of the two conductive modules, the conductive terminals include a plurality of pairs of differential signal terminals and a plurality of grounding terminals, and any two adjacent pairs of the differential signal terminals are provided with one of the grounding terminals arranged there-between;

wherein the high speed vertical connector is devoid of a conductive bar used for connecting at least two of the grounding terminals, wherein the two insulating cores of the two conductive modules are the same or a symmetrical structure, and the two insulating cores are detachably buckled with each other to form an elongated structure, wherein the elongated structure has two positioning troughs recessed on two opposite ends thereof, and the insulating body has two positioning columns facing each other and respectively inserted into the two positioning troughs, wherein an end portion of each of the two positioning columns protrudes from the corresponding positioning trough, and the end portions of the two positioning columns have different structures.

2. The high speed vertical connector as claimed in claim 1, wherein in each of the conductive terminals, the embedded segment has two concavities respectively formed on two opposite sides thereof, a distance between the bottom surfaces of the two concavities is within a range of 0.26~0.3 mm.

3. The high speed vertical connector as claimed in claim 2, wherein in each of the conductive terminals, a length of each of the two concavities is substantially 50~65% of a length of the embedded segment.

4. The high speed vertical connector as claimed in claim 1, wherein in each of the conductive terminals, the curved segment has two chamfers respectively connected to two opposite sides of the contacting segment, and the embedded segment has two chamfers respectively connected to two opposite sides of the fixing segment.

5. The high speed vertical connector as claimed in claim 1, wherein the insulating body has two buckling holes, each of the two insulating cores has a protrusion, and the protrusions of the two insulating cores are respectively buckled in the two buckling holes of the insulating body.

6. A high speed vertical connector for being applied to a frequency band within a range of 0.05~17 GHz and consisting of an insulating body, two conductive modules inserted into the insulating body, and a metallic housing sleeved at the insulating body, wherein each of the two conductive modules includes a plurality of conductive terminals arranged in one row and an insulating core fixing the row of the conductive terminals, and each of the conductive terminals is integrally formed as one elongated piece and consists of:

an embedded segment embedded in the corresponding insulating core, wherein the embedded segment has a width within a range of 0.28~0.42 mm;

a fixing segment and a curved segment respectively extending from two opposite ends of the embedded segment, wherein the fixing segment has a width within a range of 0.25~0.28 mm, and the curved segment has a width within a range of 0.35~0.42 mm; and a contacting segment extending from the curved segment, wherein the contacting segment has a width within a range of 0.25~0.28 mm;

wherein the conductive terminals of one of the two conductive modules respectively face the conductive terminals of the other conductive module; wherein in each of the two conductive modules, the conductive terminals include a plurality of pairs of differential signal terminals and a plurality of grounding terminals, and any two adjacent pairs of the differential signal terminals are provided with one of the grounding terminals arranged there-between, wherein the two insulating cores of the two conductive modules are the same or a symmetrical structure, and the two insulating cores are detachably buckled with each other to form an elongated structure, wherein the elongated structure has two positioning troughs recessed on two opposite ends thereof, and the insulating body has two positioning columns facing each other and respectively inserted into the two positioning troughs, wherein an end portion of each of the two positioning columns protrudes from the corresponding positioning trough, and the end portions of the two positioning columns have different structures.

* * * * *